United States Patent [19]

Khalek

[11] Patent Number: 4,811,005

[45] Date of Patent: Mar. 7, 1989

[54] CONTROL PROCESS AND DEVICE FOR LIQUID CRYSTAL DISPLAY

[75] Inventor: Salim Khalek, Paris, France

[73] Assignee: Satamatic, France

[21] Appl. No.: 13,660

[22] Filed: Feb. 12, 1987

[30] Foreign Application Priority Data

Feb. 12, 1986 [FR] France ..... 86 01891

[51] Int. Cl.[4] ..... G08B 21/00

[52] U.S. Cl. ..... 340/715; 340/756; 340/642

[58] Field of Search ..... 340/756, 811, 812, 803, 340/715, 642, 635, 785; 377/3, 19, 28, 39, 42, 112; 324/73 R

[56] References Cited

U.S. PATENT DOCUMENTS 3,579,205 5/1971 Aga et al. ..... 377/3
4,311,993 1/1982 Strobel ..... 340/715
4,541,066 9/1985 Lewandowski ..... 340/715
4,638,247 1/1987 Ishikawa ..... 324/73 R

FOREIGN PATENT DOCUMENTS

WO80/00038 1/1980 Int'l Pat. Institute .

OTHER PUBLICATIONS

Vellieux, "La Commande des Afficheurs à Cristaux Liquides", Toute L'Electronique, No. 491, Feb. 1984, pp. 76–81.

*Primary Examiner*—John W. Caldwell, Sr.
*Assistant Examiner*—Alvin Oberley
*Attorney, Agent, or Firm*—Darby & Darby

[57] ABSTRACT

To check the signals of the electrodes of a 7-segment display, the device comprises a multiplexing assembly, a detector of the level of the signals, a generator of clock signals of different frequencies, a pulse counter, and an anomaly detector.

9 Claims, 5 Drawing Sheets

Fig:1
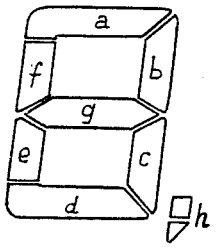
Fig:2
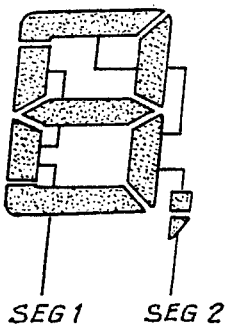
Fig:3
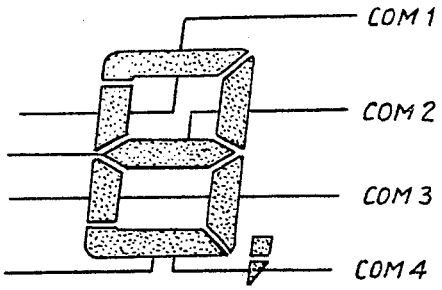
Fig:4
| | COM 1 | COM 2 | COM 3 | COM 4 |
|---|---|---|---|---|
| SEG 1 | f | g | e | d |
| SEG 2 | a | b | c | h |
Fig:6
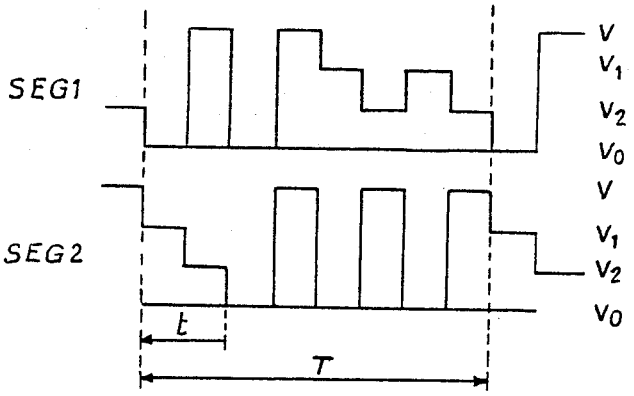

Fig. 9
| | COM 1 | COM 2 | COM 3 | COM 4 |
|---|---|---|---|---|
| SEG 1 | f | g | | |
| SEG 2 | | b | c | h |
Fig. 10
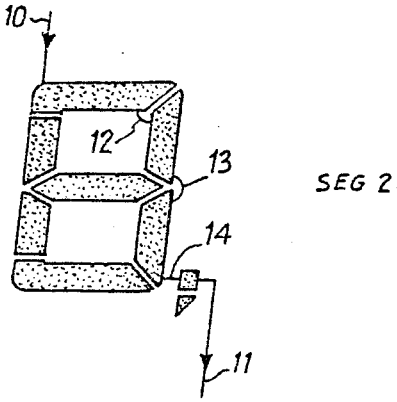
Fig. 11
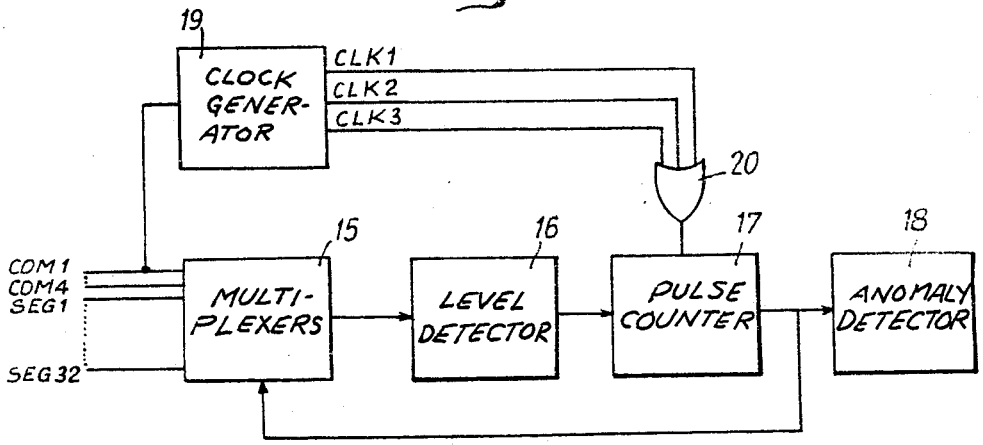

PULSE COUNTER 17
ANOMALY DETECTOR 18
SCHMITT TRIGGER
DIVIDER 36
DIVIDER 34
DIVIDER 32
OSC. 33
CLK1
CLK2
CLK3
MULTI-PLEXER 25
MULTIPLEXER 21
MULTI-PLEXER 22
MULTI-PLEXER 23
MULTI-PLEXER 24
COM1
COM2
COM3
COM4
SEG1
SEG8
SEG9
SEG16
SEG17
SEG24
SEG25
SEG32
COUNTER 38

CONTROL PROCESS AND DEVICE FOR LIQUID CRYSTAL DISPLAY

FIELD OF THE INVENTION

The invention relates to a control process for a liquid crystal display and and to the respective device.

BACKGROUND OF THE PRIOR ART

For the use of measuring assemblies including a numerical display of data it is of interest to have available a control system which permits verifying that the indications actually displayed are indeed conformable to the commands which have been sent to the displays. In case of non-concordance between the command given and the value displayed, an alarm can be given and possibly the measuring process can be stopped.

Such a system is required, for example, by the French regulations on electronic calculators used in fuel dispensers; the indications of unit price, volume delivered, amount to be paid are realized with the aid of numerical displays of seven segments.

U.S. Pat. No. 3,943,500 describes a device for the release of an alarm in case of defective functioning of a 7-segment display for the data of quantity and price of a fuel dispensing station. In this device, workable signals of intensity can be derived only with displays which produce their own light, that is, displays with incandescent filaments or with light-emitting diodes. In the case of liquid crystal displays this method cannot be applied because the current intensities are extremely low and hence practically impossible to check.

It is an object of the present invention to propose a control device for liquid crystal displays operating in multiplex, simple and cost-effective to realize, involving only numerical data.

SUMMARY OF THE INVENTION

The present invention relates to a control process of a 7-segment liquid crystal display operating in multiplex, characterized in that there are applied to the electrodes periodical signals of different amplitude levels, in such a way that for each period T the total of the surface of the diagram of each signal corresponds to a predetermined whole number of surface units, and for each electrode it is checked by means of a display output control junction that the surface of the diagram of the checked signals corresponds to said whole number of surface units.

According to other characteristics of the invention:

to measure the surface of the diagram of the checked signal, one proceeds to detect the amplitude level of said checked signal, one causes a clock signal of given frequency to correspond to each of the different amplitude levels, so that the number of clock pulses corresponds to the number of surface units of the diagram, and one counts the corresponding clock pulses during the period T, the total of the counted pulses having to correspond to said whole number of surface units;

for the case of multiplexing by 4, the signals are at three amplitude levels, and the determined number of surface units is equal to 12;

the period T is divided into four sub-periods t, the number of surface units of the diagram of each sub-period t being equal to 3.

The invention also relates to a control device for a liquid crystal display for carryig out the aforesaid process in which the signals applied to the electrodes are at different amplitude levels, characterized in that it comprises a multiplexing assembly, followed by a level detector, which in turn is followed by a pulse counter, which in turn is followed by an anomaly detector, and a clock signal generator transmitting to the counter pulses whose frequency corresponds to the amplitude of said signals, in such a way that the counter counts said pulses during a period T and delivers an output pulse only if the total of the pulses counted corresponds to a predetermined number.

According to other characteristics of the invention:

the multiplexing assembly consists, on the one hand, of a series of multiplexers fed by the control junctions of the segment lines, and, on the other hand, of a multiplexer fed by the outputs of the multiplexers and by the control junctions of the common electrodes;

in the case of multiplexing by 4, the level detector consists of three comparators, each having a reference voltage corresponding to one of the three amplitude levels to be detected;

the clock signal generator comprises essentially an astable oscillator and frequency dividers delivering each frequency which is a sub-multiple of that of the oscillator;

the output pulse of the pulse counter serves to increment the multiplexing assembly and to reset the anomaly detector to zero.

Lastly the invention relates to a 7-segment liquid crystal display intended to be checked by the aforesaid device with the aforesaid process, characterized in that, on the one hand, for each electrode a control junction is arranged in order to verify that the electrical signals applied to the electrode have indeed been received, and on the other hand the segments of one and the same line are connected together by connections as short as possible and arranged at the ends of the segments, to check these segments over their entire length.

BRIEF DESCRIPTION OF THE DRAWINGS

Other characteristics of the invention will be evident from the description which follows, made with reference to the annexed drawing.

In the drawings:

FIG. 1 shows a diagram of a display with 7 segments and a decimal point;

FIG. 2, a diagram of the two lines of segments of a display multiplexed by 4;

FIG. 3, a diagram of the four common electrodes of the display of FIG. 2;

FIG. 4, a table giving the segments lighted as a function of the segment lines of FIG. 2 and of the common electrodes of FIG. 3;

FIG. 6, a diagram of signals applied to the segment lines of FIG. 2 to display the character 4;

FIG. 7, a diagram of the resulting signal applied to the segment a;

FIG. 9, a table of the lighted segments in the case of FIG. 6;

FIG. 10, a diagram of a display equipped with a command junction and with a control junction, according to the invention;

FIG. 11, a functional diagram of the display control circuit;

DESCRIPTION OF THE PREFERRED EMBODIMENTS

To begin with, we recall that a liquid crystal display is composed of two glass plates between which the liquid crystals are contained. Under the upper plate are tracks of indium oxide (a transparent electric conductor) which have the form of the characters to be displayed, that is, of the segments in the case of 7-segment displays.

On the lower plate are other tracks called common electrodes, the number of which depends on the display method: 1 in the case of static display, 2 in the case of display multiplexed by 2, 4 in the case of display multiplexed by 4, and so forth. The application of voltage between the common electrode and the electrode relating to a segment permits making this segment visible.

The example of realization described below relates to a display of 7 segments and a decimal point, multiplexed by 4. It goes without saying that the invention applies regardless of the degree of multiplexing, and it applies even to static display.

The seven segments and the decimal point are labeled with the letters a to h in FIG. 1. In the case of display multiplexed by 4, the segments are distributed over two lines, SEG 1 and SEG 2, respectively, (FIG. 2), while the common electrodes COM 1 to COM 4 are assigned to four groups of segments (FIG. 3).

The application of voltage between line SEG 2 and the common electrode COM 1 produces the lighting of the single segment a, and so forth according to the table of FIG. 4.

To control a 7-segment numerical display multiplexed by 4, one uses an electric signal comprising three voltage levels besides zero, respectively:

$$V;\ V1=\tfrac{2}{3}V;\ V2=\tfrac{1}{3}V.$$

Figure 5:
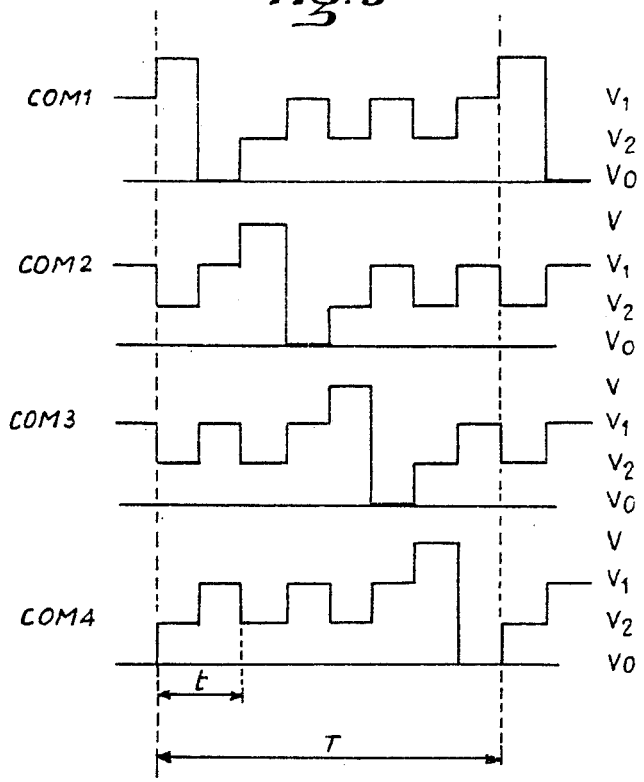
FIG. 5, a diagram of the signals applied to the common electrodes of a 7-segment display multiplexed by 4.

The signals applied to the four common electrodes during a period T are represented in FIG. 5. Each period T can be divided into four sub-periods t. The signals are applied with a period T, permanently.

Figure 7:
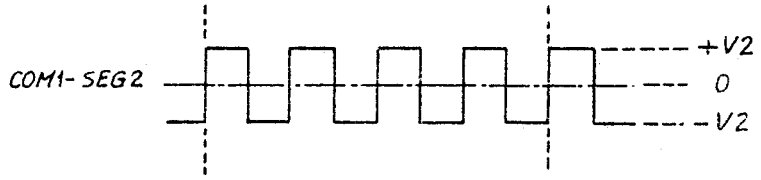
Figure 8:
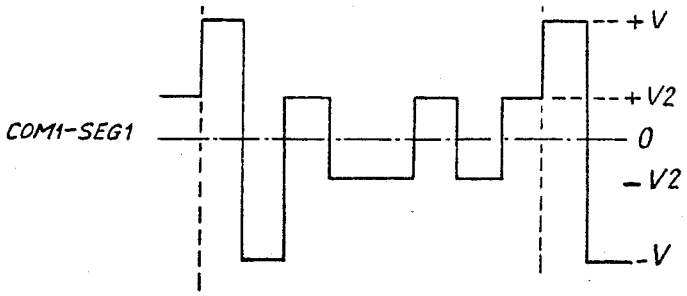
FIG. 8, a diagram of the resulting signal applied to the segment f.

The signals applied to the segment lines SEG 1 and SEG 2 vary as a function of the character to be displayed. Thus, the signals of FIG. 6 correspond to the character 4. In fact, if one considers the segment a, its state depends on the voltage between the electrodes COM 1 and SEG 2 (FIG. 4). This voltage is represented in FIG. 7, and it is insufficient to light up the segment a. If we consider the segment f, its state depends on the voltage between the electrodes COM 1 and SEG 1 (FIG. 4). This voltage, represented in FIG. 8, is sufficient for lighting the segment f, as it attains the value ±V.

In the table of FIG. 9 are mentioned only the lighted segments which correspond to the character 4, with the signals SEG 1 and SEG 2 of FIG. 6.

At this stage of the description two important observations must be made about the form of the command signals of FIGS. 5 and 6:

For each sub-period $t=T/4$, the surface of the diagram is always the same and equal to 3 surface units, taking as unit the surface of respective sides V2 and t/2; for each period T, the surface of the diagram is always the same and equal to 12 surface units.

It is on these two observations that the control process according to the invention is based. In fact, this control consists in verifying that a display, having received a certain command, has indeed carried it out correctly. It is assumed that the display was originally correctly constructed and installed. A deterioration of the display in the course of time can be due only to the following anomalies:

Physical-chemical deterioration of the display plate. In this case all segments of the plate are affected as the fluid is common to all. This is a visually perceptible flagrant defect;

shortcircuiting of two segments. The signal applied to these segments will be altered, which in some cases will entail erroneous display;

cutting of a segment or of the corresponding common electrode portion. For example, the cutting of segment e transforms the character 8 into the character 9.

The control device according to the invention has for its object, therefore, to detect that all segments of a display are indeed powered (open circuit check) and that there is no shortcircuit between two segments of one and the same display, or between segments of two different displays (shortcircuit check).

The open circuit check consists in verifying that a segment is indeed correctly powered, that is, that the common electrode has been subjected to the voltage signal corresponding to it, and that the segment line has been subjected to the voltage signal corresponding to it.

To assure this check, one uses first of all a structural arrangement: Each segment line, which comprises a command junction 10 (FIG. 10) receiving the signal, is equipped with a control junction 11 permitting to verify that this signal has indeed been received. Moreover, the segments of one and the same line (SEG 2, FIG. 10) are connected to one another by connections 12, 13, 14 as short as possible, but arranged at the ends of the segments, like the junctions 10 and 11. Owing to this, the circuit between the command junction 10 and the control junction 11 traverses the segments over practically their entire length in order to verify their state. The same arrangement is applied to the common electrodes, which also comprise a control junction opposite the command junction.

To ensure the open-circuit check, also a logic arrangement is used: On each control junction the diagram of the voltage is recorded. If the signals are properly applied, the diagram presents a surface of 12 units per period T. If not, the surface of the diagram is different from 12.

This latter arrangement applies also to the shortcircuit check. A shortcircuit may occur between two segment lines, between two common electrodes, or between a common electrode and a segment line. It should be noted that if two elements are in shortcircuit, it is always the higher potential which imposes itself on the two elements. This remark applies if protective diodes are added in the circuit delivering the reference voltages V, V1, V2.

From the diagrams of FIG. 5 and 6 it can easily be seen, for example, that in case of shortcircuit between the segment lines SEG 1 and SEG 2 the resulting diagram has a surface of 18 units, whereas in case of shortcircuit between the two common electrodes COM 1 and COM 2 it has a surface of 16 units, and that in case of shortcircuit between SEG 1 and COM 1 it has a surface of 18 units. In all cases it is found that the short-circuiting of two electrodes produces a modification of the nominal surface of the diagram. This property is utliized for detecting the defects.

Each 7-segment character comprises four common electrodes COM 1 to COM 4 and two segment line electrodes SEG 1 and SEG 2. Each of these electrodes comprises a command junction 10 (FIG. 10) for applying the voltage signal to it, and a control junction 11 for analyzing the signal transmitted by the electrode. If the surface of the diagram of this signal during each sub-period $t=T/4$ is indeed equal to three units, and if during each period T it is indeed equal to twelve units, then we are in the presence of a normal signal. In the contrary case, we have a defect.

An example of realization of a control device for liquid crystal display according to the invention will now be described in the case of an electronic calculator for fuel dispensing.

On the calculator are displayed: the amount to be paid (6 digits); the volume delivered (6 digits) and the unit price (4 digits). The device must check the aggregate constituted by the 16 digits and comprising: 4 electrodes (COM 1 to COM 4) which are common to all digits, 16 lines of segments SEG 1 and 16 lines of segments SEG 2, or a total of 36 electrodes.

The control is performed successively on each of the electrodes, by the control junction, so as to use one control device only.

In order to eliminate any error due to a parasitic electrical interference, the check is repeated several times in case of anomaly. If after four checks, for example, the anomaly no longer appears, it is regarded to have been due to a parasitic interference. If it is still present, an alarm signal is released.

FIG. 11 represents a functional scheme of the display control device according to the invention. The control junctions of the 36 electrodes COM 1 to COM 4 and SEG 1 to SEG 32 go to the multiplexer 15, the output of which is connected to a level detector 16, which in turn is connected to a pulse counter 17. The output of the counter is connected on the one hand to an anomaly detector 18 which furnishes the alarm signal, and on the other hand to the multiplexer 15. The common electrode COM 1 is also connected to the input of a clock signal generator 19, which delivers at its three outputs pulses of different frequencies. All these pulses go through an OR gate 20 and are counted by the counter 17.

The control of the displays occurs in a sequential manner. The signal is checked on the 36 electrodes owing to the use of multiplexers. To calculate the surface of the diagram of one of the 36 signals, during a period T, which surface must be equal to 12 units, one detects the three voltage levels which compose the signal: $V, V1=\frac{2}{3}V$, $V2=\frac{1}{3}V$. To each of these levels there corresponds a clock signal which serves to increment a counter by 3, 2 and 1 units, respectively. As f3 is the frequency of the clock signal CLK3 which corresponds to the detection of the level $V2=\frac{1}{3}V$, the frequencies of the clock signals CLK2 and CLK1 which correspond to the detection of the levels $V1=\frac{2}{3}V$ and V are, respectively, $f2=2\ f3$ and $f1=3\ f3$.

If at the end of the control period T the number N of the counted units is 12, control of the following signal is authorized. If, on the contrary, this number N is different from 12, control of the same signal is recommenced during a new period, and so forth up to four. At that moment, if the number N is still different from 12, the anomaly detector 18 releases an alert signal.

Figure 12:
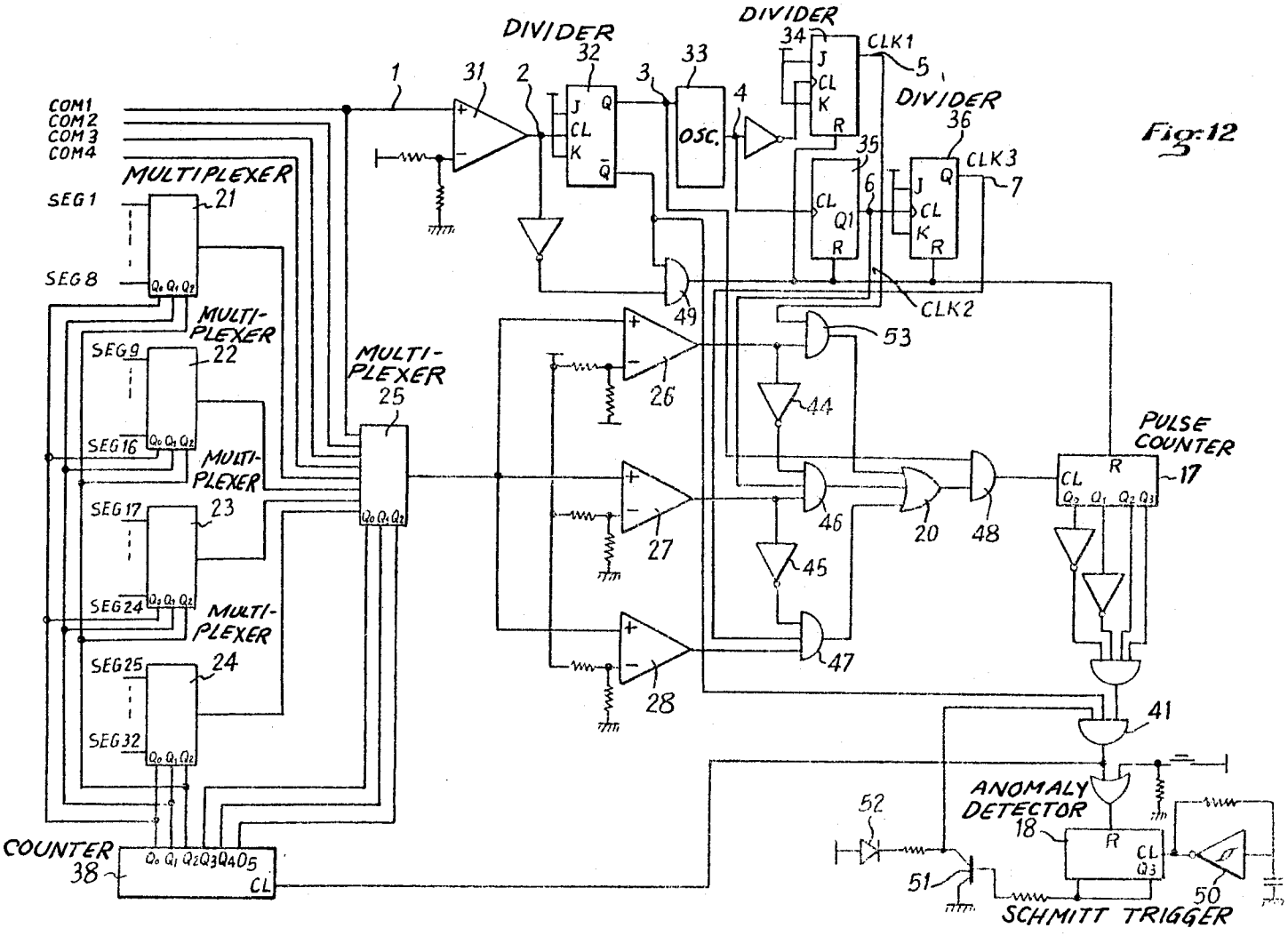
FIG. 12, a circuit diagram of the display control circuit.

The circuit diagram of FIG. 12 corresponds to the block diagram of figure 11. The 36 control electrodes COM 1 to COM 4 and SEG 1 to SEG 32 are symbolized at left. The control electrodes of the segment lines are regrouped in series of 8, each series ending at a multiplexer with 8 inputs: The electrodes SEG 1 to SEG 8 are connected to the multiplexer 21, the electrodes SEG 9 to SEG 16 to the multiplexer 22, the electrodes SEG 17 to SEG 24 to the multiplexer 23, and the electrodes SEG 25 to SEG 32 to the multiplexer 24. The four outputs of the multiplexers 21 to 24 as well as the four common electrodes COM 1 to COM 4 are connected to the 8 inputs, respectively, of the multiplexer 25. The assembly of the five multiplexers 21 to 25 corresponds to the multiplexing sub-assembly 15 of FIG. 11.

The level detector 16 of FIG. 11 corresponds to the three comparators 26, 27 and 28 which permit detecting the levels V, $\frac{2}{3}V$ and $\frac{1}{3}V$, respectively. The threshold voltages are 5/6 V, $\frac{1}{2}V$ and 1/6 V, respectively. They are obtained from the reference voltage of the entire circuit, which is V.

The clock signal generator 19 of FIG. 11 consists of the following elements: A level detector 31, actually a comparator, serving to detect the change-over of electrode COM 1 to the value V, which takes place once per period T; a divider by two 32, which determines the control sequences; an astable oscillator 33, released when the output Q of the divider 32 is high, and having a frequency of 48/T; a divider by two 34, delivering the clock signal CLK 1, the frequency of which is $fl=24/T$; a divider by three 35, delivering the clock signal CLK 2 of frequency $f2=16/T$; and a divider by two 36, delivering the clock signal CLK 3, of frequency $f3=8/T$.

In FIG. 12 is seen also the OR gate 20, the pulse counter 17, and the anomaly detector 18 of FIG. 11.

The divider by two 32 is a flip-flop of type JK. Assuming that its output Q is in the low state, the first detection of the level V on the electrode COM 1 will produce the change-over to the high state of output Q, and it will be possible to observe all signals represented in FIG. 13, during a period T. The second detection of the level V on the electrode COM 1 will produce the changeover to the low state of output Q and, during a period T, no clock signals will be observed.

The circuit of FIG. 12 comprises further a counter 38, 6 bits, fed by the output of gate 41. The three bits of lowest weight Q0, Q1, Q2 serve to select one of the signals SEG 1 to SEG 8 or SEG 9 to SEG 16 or SEG 17 to SEG 24 or SEG 25 to SEG 32, whereas the three bits of highest weight Q3, Q4, Q5 serve to select one of the multiplexers 21 to 24 or one of the common signals COM 1 to COM 4.

Each common signal is controlled eight successive times per cycle of 64 controls while each of the signals SEG 1 to SEG 32 is controlled once only during the same cycle.

Figure 13:
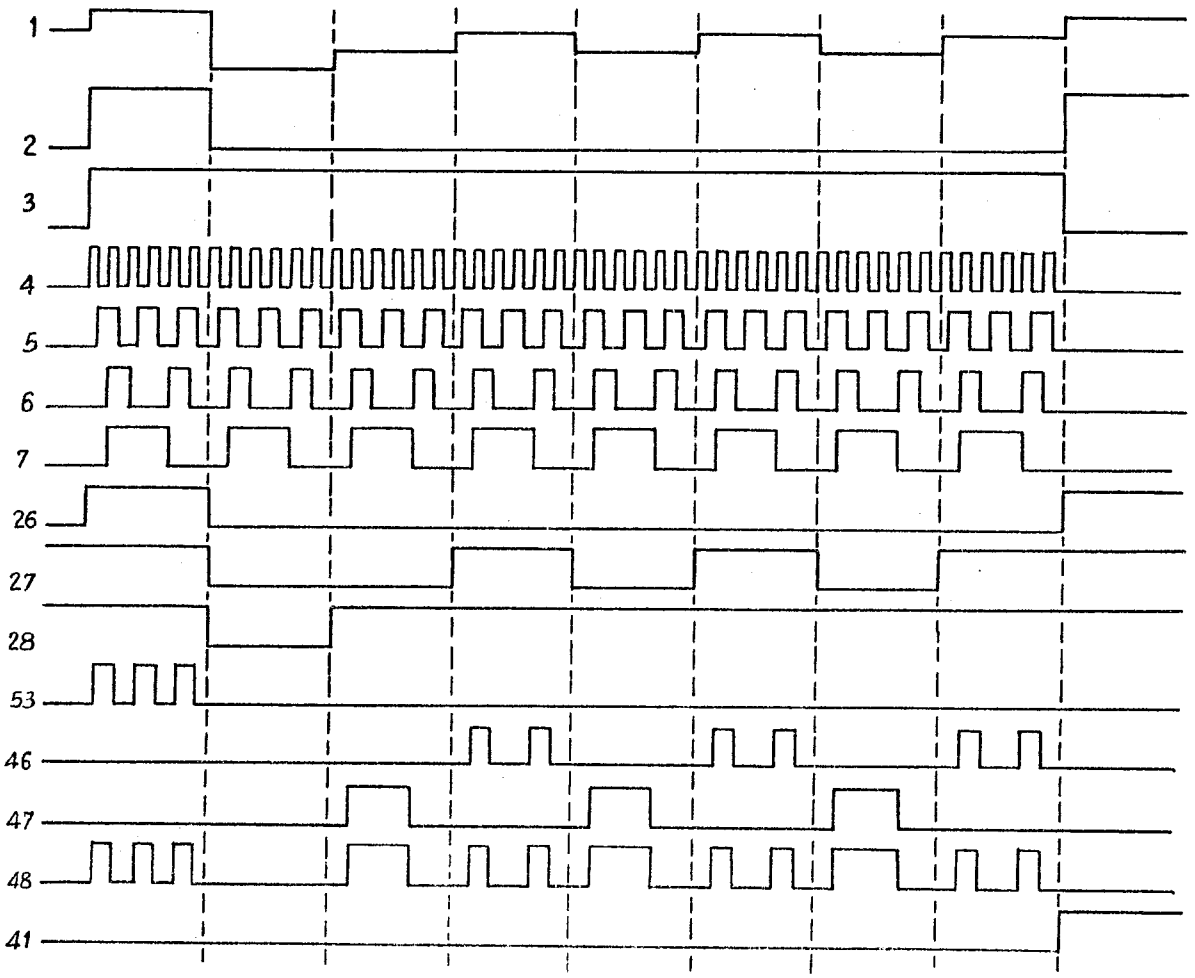
FIG. 13, a diagram of signals, as a function of time, at different points of the circuit of FIG. 12.

The output of multiplexer 25 acts directly on the three level detectors 26, 27, 28. When the output of detector 26 is high, those of the detectors 27 and 28 are also high (FIG. 13). Therefore, the clock signals CLK 2 and CLK 3 must be inhibited and the clock signal CLK 1 allowed to pass, which will increment the counter 17 by three units during a period T/8. The inhibition of the clock signals CLK 2 and CLK 3 occurs by means of the inverters 44 and 45 and of the gates 46 and 47, respectively. The clock signals CLK2 and CLK3, when they are authorized, increment the counter 17 by two units and by one unit, respectively, during a period T/8.

At the end of the period T, the output Q of the divider by two 32 changes over to the low state and the incrementation of counter 17 is inhibited because the output signal of gate 20 can no longer go through gate 48. If at that moment the output state of counter 17, Q0 Q1 Q2 Q3=0011, which corresponds to 12 units counted, there appears at the output of gate 41 a pulse of duration T/8 which increments the counter 37 or 38 and permits the control of the following signal.

The dividers 34, 35 and 36 and the counter 17 are reset to zero by the gate 49 at the beginning of each control cycle.

The anomaly detector 18 comprises essentially a counter which is reset to zero by each output pulse of gate 41. If at the end of a control period the output of counter 17 does not correspond to 12 units, that is, is not 0011, no pulse is transmitted by gate 41, and counter 38 is not incremented.

Hence the same signal is selected to be controlled again, and the same operation is repeated. If the error originated from an electrical interference, for example, it may be found to be corrected in the second or third check, and the process continues automatically. If the error is due to a defect, it will persist. The Schmitt trigger 50 functions as oscillator and the counter 18 counts pulses of a frequency 16 n/T. If it is not periodically reset to zero by the pulses coming from gate 41, its output Q3 will, after a certain time (2nT), change over to the high state and the transistor 51 becomes conducting, thereby inhibiting gate 41. The light-emitting diode 52 is then lighted and constitutes a warning light, for example. It may be supplemented by a stop command or an acoustic alarm for example.

FIG. 13 traces the electric signals at points 1 to 7 of the circuit of FIG. 12, and at the output of a certain number of gates, the references of which are indicated in the margin.

It is thus seen that the 7-segment display control device according to the invention ensures by simple means an efficient control by simple counting of a defined number of pulse 12 (sic) during a measuring period.

I claim:

1. A control process for a 7-segment liquid crystal display operating in multiplex, said display having control electrodes and display outputs, comprising the steps of: applying periodical signals to the electrodes, each signal having different levels of amplitude with respect to a given period T wherein said each level is related to each other level by a ratio of integers, each signal having a respective diagram representing amplitude of each applied signal with respect to time, each diagram having a respective total surface, so that for each such period T, the total surface of the diagram of each signal corresponds to a predetermined whole number of surface units, and multiplexing a control signal at a control junction at the display output, said control signal having a diagram representing amplitude with respect to time wherein said control signal diagram has a surface that is measured and said multiplexing determines whether the surface of the diagram of the controlled signal corresponds to said whole number of surface units.

2. Control process according to claim 1, wherein, for measuring the surface of the diagram of the controlled signal, steps are included comprising: detecting the amplitude level of said controlled signal, causing a clock signal of a given frequency to correspond to each of the different amplitude levels, so that the number of clock pulses corresponds to the number of surface units of the diagram, and counting the corresponding clock pulses during the period T, the total of the counted pulses having to correspond to said whole number of surface units.

3. Control process according to claim 2, wherein, for multiplexing by 4, the signals are at three amplitude levels, and the determined number of surface units is equal to twelve.

4. Control process according to claim 3, wherein the period T is divided into four sub-periods t, the number of surface units of the diagram for each sub-period t being three.

5. Control device for a liquid crystal display having control electrodes and segment lines and operating in multiplex comprising: control junctions being provided at the segment lines of the liquid crystal display; means for applying periodical signals to the control electrodes wherein each signal has different amplitude levels with respect to time; a multiplexing assembly responsive to signals developed at said control junctions, followed by; a level detector responsive to said multiplexing assembly; a pulse counter responsive to said level detector; an anomaly detector responsive to said pulse counter; and a clock signal generator transmitting to said pulse counter pulses whose frequency corresponds to the amplitude of said applied signals, said counter counting said pulses during a period T and delivering an output pulse to said anomaly detector only if the total of the pulses counted corresponds to a predetermined number.

6. Device according to claim 5, wherein the multiplexing assembly includes a series of multiplexers fed by the control junctions of the segment lines.

7. Device according to claim 5, wherein, for multiplexing by 4, the level detector includes three comparators, each having a reference voltage corresponding to one of the three amplitude levels to be detected.

8. Device according to claim 5, wherein the clock signal generator comprises essentially an astable oscillator and frequency dividers, each delivering a frequency which is a submultiple of that of the oscillator.

9. Device according to claim 5, wherein the output pulse of the pulse counter serves to increment the multiplexing assembly and to reset the anomaly detector to zero.

* * * * *